US007405645B2

(12) United States Patent
Fontaine et al.

(10) Patent No.: US 7,405,645 B2
(45) Date of Patent: Jul. 29, 2008

(54) THERMALLY ACTIVATED CIRCUIT INTERRUPTER

(75) Inventors: Lucien P. Fontaine, Lincoln, RI (US); Stephen J. Bryant, Coventry, RI (US)

(73) Assignee: Sensata Technologies, Inc., Attleboro, MA (US)

( * ) Notice: Subject to any disclaimer, the term of this patent is extended or adjusted under 35 U.S.C. 154(b) by 303 days.

(21) Appl. No.: 11/407,664

(22) Filed: Apr. 20, 2006

(65) Prior Publication Data

US 2007/0247272 A1 Oct. 25, 2007

(51) Int. Cl.
*H01H 71/16* (2006.01)
*H01H 37/52* (2006.01)

(52) U.S. Cl. ..... 337/70; 337/37; 337/66; 337/72; 337/75; 337/79

(58) Field of Classification Search ..... 337/66, 337/37, 70, 72, 75, 79
See application file for complete search history.

(56) References Cited

U.S. PATENT DOCUMENTS 2,686,241 A * 8/1954 Straub et al. ..... 337/55
2,696,538 A * 12/1954 O'Neill ..... 337/91
3,579,167 A * 5/1971 Grable ..... 337/102
3,584,168 A * 6/1971 Halpert et al. ..... 200/83 R
3,686,601 A * 8/1972 Kaszmarek et al. ..... 337/66
3,913,049 A * 10/1975 Burch ..... 337/75
3,924,213 A * 12/1975 Semple ..... 337/130
4,039,991 A * 8/1977 Bucheister ..... 337/348
4,371,859 A * 2/1983 Sorimachi ..... 337/365
4,480,246 A * 10/1984 Schmitt ..... 337/348
5,003,282 A * 3/1991 Boulanger ..... 337/348
5,012,495 A * 4/1991 Munroe et al. ..... 337/3
5,861,794 A 1/1999 Pellon
6,072,381 A * 6/2000 Yu ..... 337/37
6,084,193 A * 7/2000 Pellon ..... 218/117
6,121,868 A * 9/2000 Chiang ..... 337/37
6,307,460 B1 * 10/2001 Yu ..... 337/37

(Continued)

FOREIGN PATENT DOCUMENTS

EP 409611 A2 * 1/1991

(Continued)

*Primary Examiner*—Anatoly Vortman
(74) *Attorney, Agent, or Firm*—Russell E. Baumann

(57) ABSTRACT

A thermally activated circuit interrupter (10) has a cantilever mounted, snap acting thermostatic disc (16) mounting a movable electric contact (18) that is adapted to move between a contacts engaged position and a tripped, contacts disengaged position. A pivot member (24) is rotatably mounted above the thermostatic disc and movably mounts a latch (**26*d*) that is biased by spring arm (26*a*) against the edge of the free end of thermostatic disc (16) in the contacts engaged position and is moved under the thermostatic disc when the disc moves to the contacts disengaged position. An arm (24*b*) of the pivot member transfers motion to a trip indicator button (32) pushing the button to an exposed position upon rotation of the pivot member when the thermostatic disc moves to the tripped configuration and the latch moves under the disc. The trip indicator button also serves as a reset button so that upon cooling of the thermostatic disc to the reset temperature, the button can be depressed transferring motion to the arm (24*b***) of the pivot member thereby moving the latch from under the disc allowing the disc to move to the contacts engaged configuration.

11 Claims, 5 Drawing Sheets

U.S. PATENT DOCUMENTS 6,577,221 B1 * 6/2003 Wang ..... 337/59
6,590,489 B1 * 7/2003 Ullermann et al. ..... 337/56
6,710,695 B1 * 3/2004 Pellon et al. ..... 337/66
6,720,856 B1 * 4/2004 Pellon et al. ..... 337/82
6,744,345 B2 * 6/2004 Korczynski et al. ..... 337/358
7,034,650 B2 * 4/2006 Yu ..... 337/59

FOREIGN PATENT DOCUMENTS

JP 2002231117 A * 8/2002

* cited by examiner

THERMALLY ACTIVATED CIRCUIT INTERRUPTER

FIELD OF THE INVENTION

This invention relates generally to electrical circuit interrupters and more specifically to such circuit interrupters that employ current carrying, thermostatic snap acting discs.

BACKGROUND OF THE INVENTION

It is known to mount a current carrying thermostatic disc in a device so that it will snap between contacts engaged and contacts disengaged configurations in dependence upon the temperature of the disc. Electric current passing through the disc generates heat thereby raising the temperature of the disc. Current levels above a selected level and duration will raise the temperature of the disc to a preselected level causing the disc to snap to a contacts disengaged configuration thereby breaking the electrical circuit until the disc cools off to a lower, reset temperature when the disc automatically snaps back to a contacts engaged configuration re-energizing the electric circuit.

In U.S. Pat. No. 5,861,794, assigned to the assignee of the present invention, a thermally responsive circuit breaker has a thermostatic, snap acting disc cantilever mounted on an electric terminal. A movable electric contact is mounted on a free distal end of the disc for movement into and out of engagement with a stationary electrical contact mounted on another electric terminal as the disc moves between oppositely dished configurations. A movable reset member is mounted in the housing of the circuit breaker having a surface extending generally parallel and closely adjacent to a flexible gasket extending over the housing chamber. A leg attached to the reset member has a projection that is biased against the edge of the free distal end of the thermostatic disc when in the contacts engaged configuration and is adapted to move under the lip of the disc upon movement of the disc to the contacts disengaged configuration thereby preventing closure of the contacts. The circuit breaker can be reset by a force applied through the gasket by a force application member such as a rocker or button to move the leg attached to the reset member out from under the disc thereby allowing the disc to move into the contacts engaged configuration. Although the circuit breaker is effective, it does not provide visual indication of an overload trip of the circuit breaker.

SUMMARY OF THE INVENTION

It is an object of the present invention to provide a trip free, thermally activated circuit interrupter having positive indication of an overload tripped condition of the interrupter. Another object is the provision of a thermally activated circuit interrupter that is of simple construction and is easily assembled. Yet another object of the invention is to provide a trip free, thermally activated circuit interrupter that overcomes the limitation of the prior art noted above. Other objects and advantages will be in part apparent and in part pointed out hereinafter.

The invention accordingly comprises the elements and combination of elements, features of construction and arrangement of parts which will be exemplified in the structures herein described, the scope of the invention of which will be indicated in the appended claims.

Briefly, in accordance with a preferred embodiment of the invention, a thermally activated circuit interrupter has a cantilever mounted, current carrying, snap acting thermostatic disc mounting a movable electrical contact adapted to move into and out of engagement with a stationary electrical contact. A combination pivot member, latch, trip indication and reset assembly is disposed over the thermostatic disc. The pivot member has first and second legs, the second leg mounting a latch that is biased into a first latch position in engagement with the edge of the free end portion of the thermostatic disc when the disc is in the contacts engaged position and which moves to a second latch position under the surface of disc on either side of the movable electric contact mounted on the disc when the disc snaps to the contacts disengaged position. In the preferred embodiment shown and described, two latches are integrally formed with respective spring members mounted on the pivot member, the spring members having legs that react against a fixed surface of the housing to provide a bias urging the pivot member to rotate in a direction from the first latch position toward the second latch position. The first leg of the pivot member extends to a location adjacent to a trip indicator button. When the disc snaps to the tripped, contacts disengaged position, the pivot member rotates as a result of the spring force and transfers motion through the first leg to the trip indicator button moving it into an exposed position extending through an aperture in the cover of the interrupter housing thereby providing visual indication of an overload trip condition. The button also serves as a reset member so that when the disc cools to the reset temperature, depressing the button will transfer motion to the first arm of the pivot member to rotate the pivot member and move the latch from under the disc allowing the disc to move to the contacts engaged position with the latch biased against the edge of the disc. In this position with movement of the latch and pivot member limited, the button moves to a recessed position under the influence of a separate button spring.

BRIEF DESCRIPTION OF THE DRAWINGS

Other objects and features of the invention will become apparent by reference to the following detailed description of preferred embodiments when considered in connection with the accompanying drawings in which like reference characters refer to like components or structural features throughout the several views wherein:

FIG. 5(*a*) is a side elevational view of the FIG. 5 combination spring and latch;

FIG. 6(*a*) is a side elevational view of the FIG. 6 sub-assembly.

DETAILED DESCRIPTION OF PREFERRED EMBODIMENT

Figure 1:
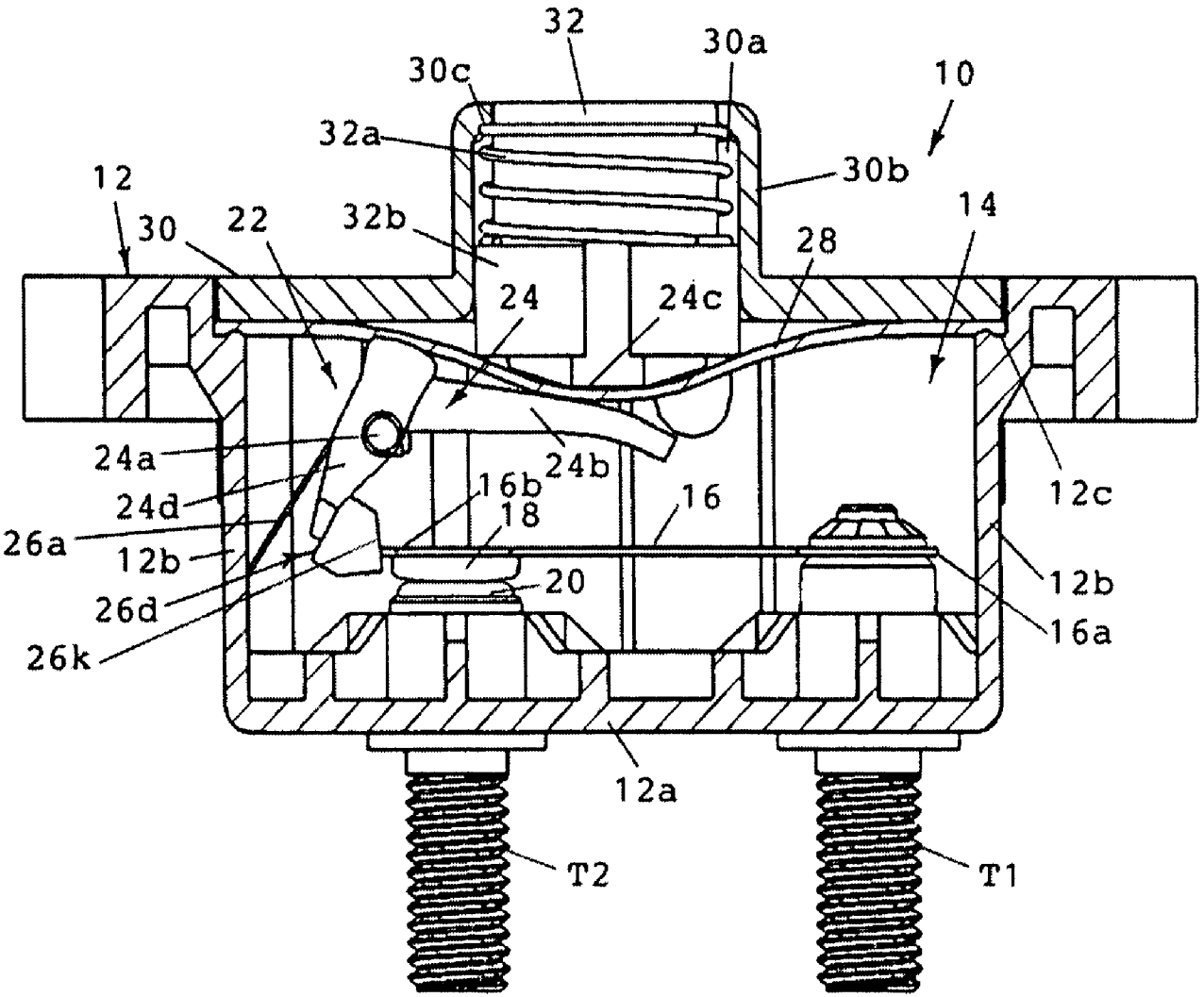
FIG. 1 is a cross sectional elevational view of a thermally responsive circuit interrupter made in accordance with a preferred embodiment of the invention in the contacts engaged or closed position.
Figure 2:
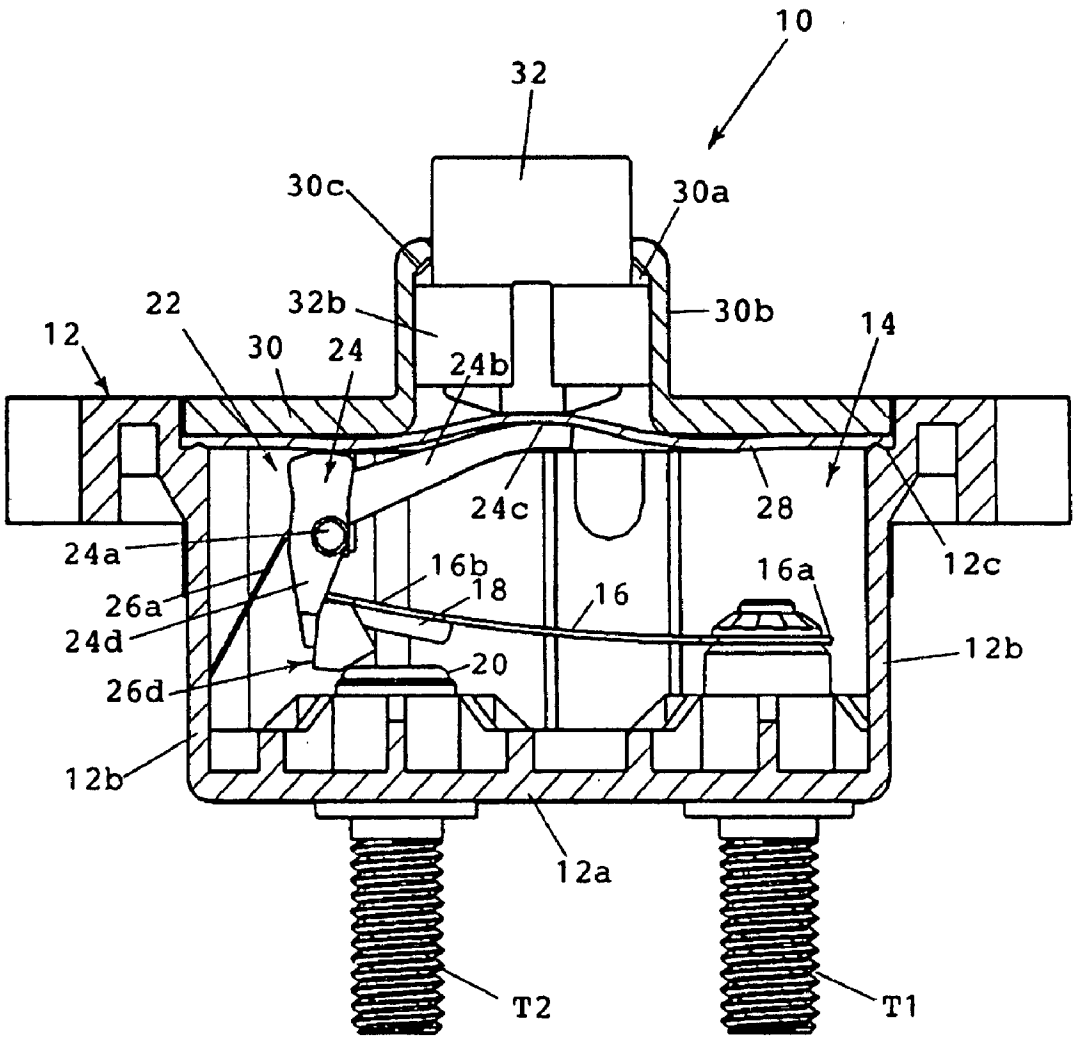
FIG. 2 is similar to FIG. 1 but shows the interrupter in the contacts disengaged or tripped position.

With particular attention to FIGS. 1 and 2, thermally responsive circuit interrupter 10, made in accordance with a preferred embodiment of the invention, includes a housing 12 formed of suitable electrical insulative material, such as plastic, having a bottom wall 12*a* and side walls 12*b* extending upwardly from the bottom wall to form an electric switch chamber 14. First and second electric terminals T1, T2 extend into switch chamber 14 through spaced apart apertures in bottom wall 12*a*. A current carrying thermostatic disc 16 composed of a suitable bimetal or the like has one end 16*a* suitably attached to terminal T1 in cantilever fashion with a movable electric contact 18 mounted on free distal end portion 16*b* of the disc along the longitudinal axis 2 of the disc by any suitable means, such as welding thereto, and is adapted to move into and out of electrical engagement with a stationary electric contact 20 suitably mounted on terminal T2. Disc 16 is formed into a dished shaped configuration in a known manner so that it will snap between a first relatively downward concave configuration shown in FIG. 1 and a relatively downward convex configuration shown in FIG. 2 in dependence upon preselected temperatures of the disc.

Figure 4:
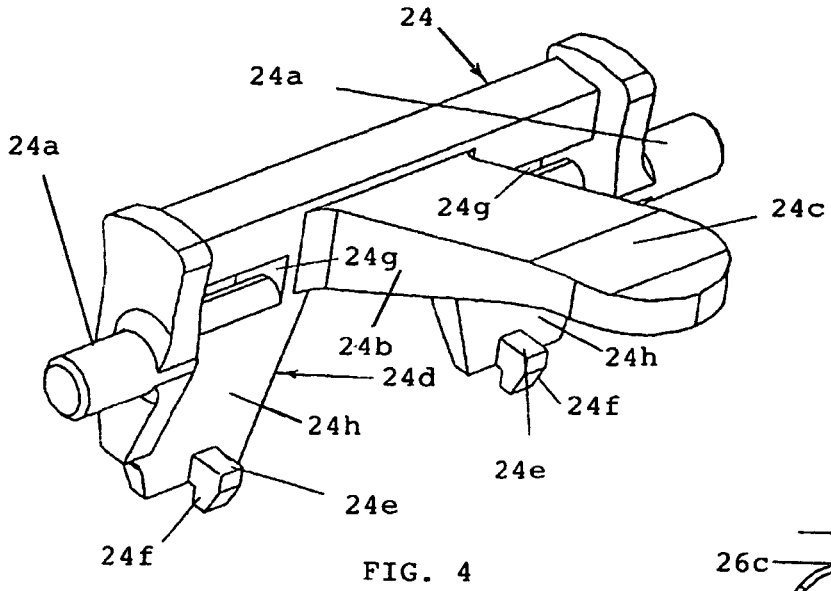
FIG. 4 is a perspective view of the pivot member of the FIGS. 1, 2 structure.
Figure 5A:
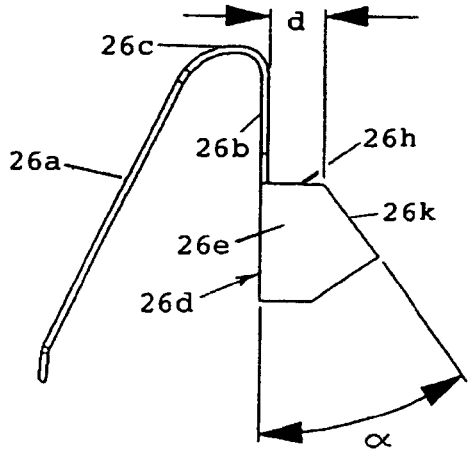
FIG. 5 is a perspective view of a combination spring and latch of the FIGS. 1, 2 structure.
Figure 5:
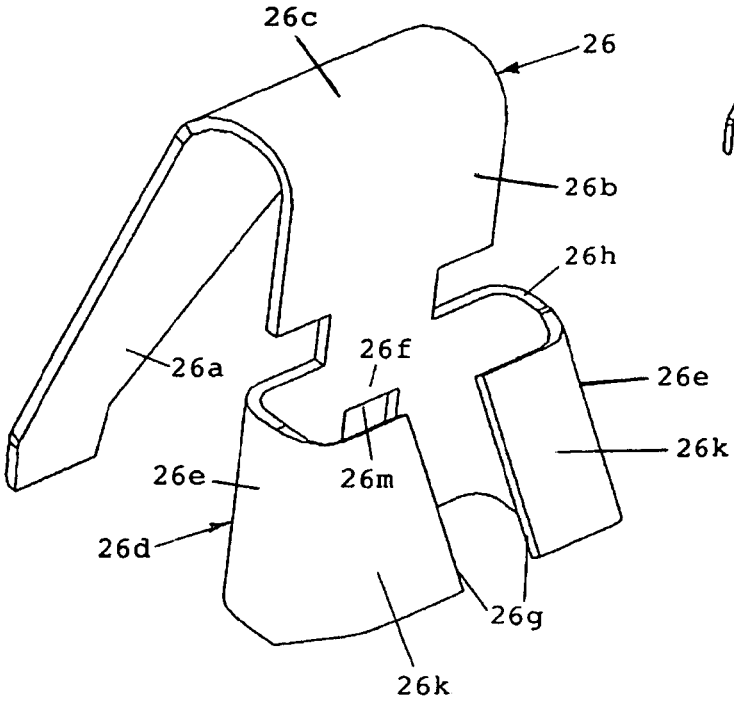
Figure 6:
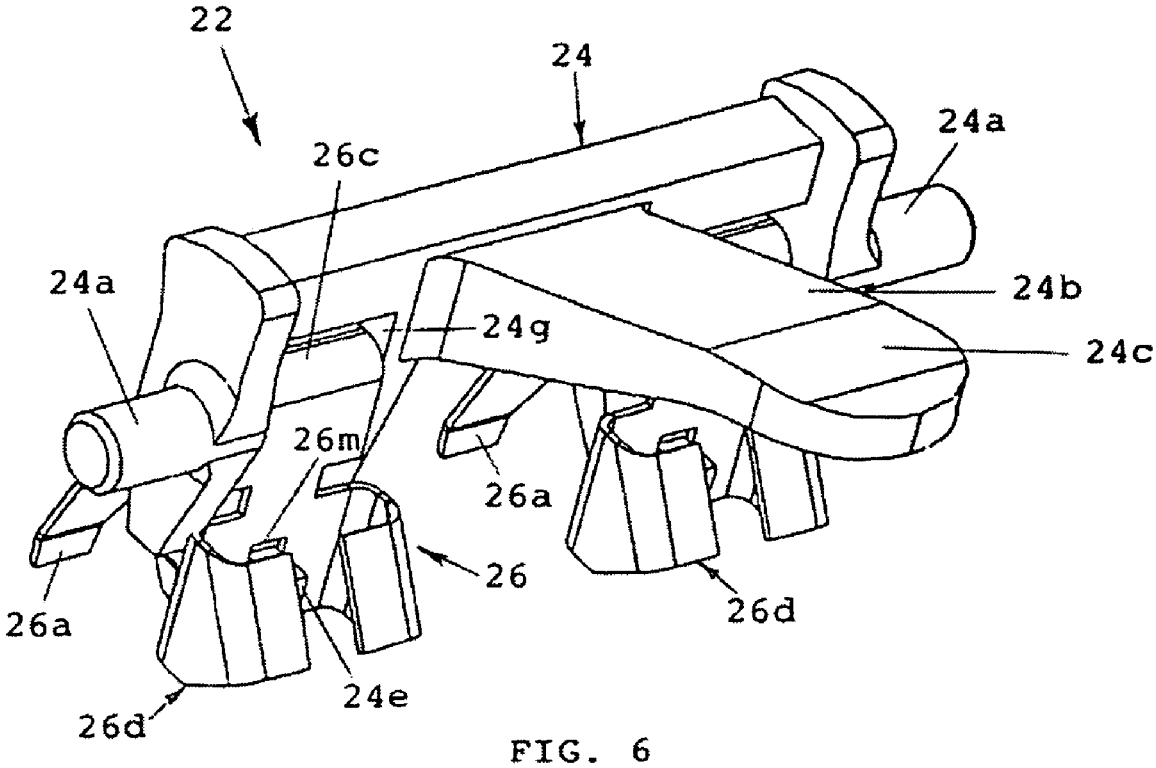
FIG. 6 is a perspective view of the pivot member and latch sub-assembly.
Figure 6A:
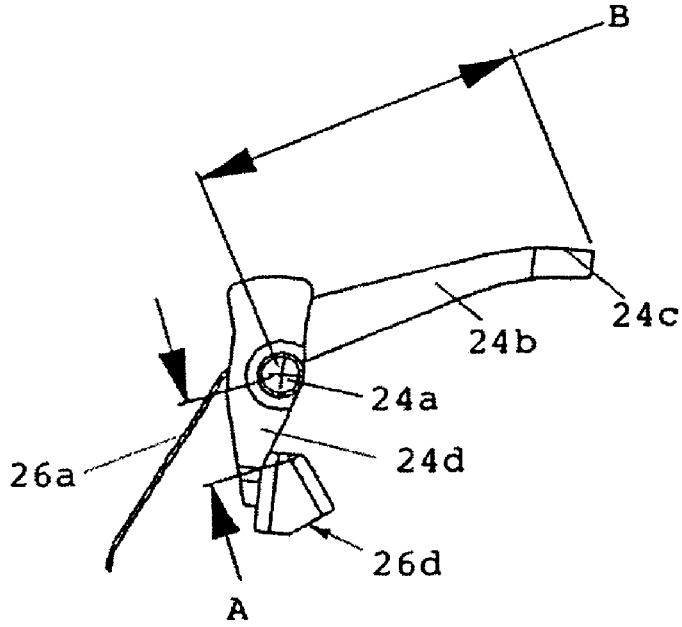

With further reference to FIGS. 4-6, a combination latch and pivot member sub-assembly 22 comprises a pivot member 24 composed of suitable material such as a thermoplastic or thermoset polymer and having transversely, outwardly extending, aligned journals 24*a* that serve as pivots about which pivot member 24 rotates. Journals 24*a* are received in opposed slots (not shown) formed in two opposed side walls 12*b* with the pivot member mounted above the free end 16*b* of thermostatic disc 16. Pivot member 24 is provided with a first arm 24*b* extending from the pivot member above the pivot location of journals 24*a* as seen, for example, in FIG. 6(*a*), that extends outwardly from the center of rotation of journals 24*a* a distance B that includes a force transfer surface 24*c*. A spaced apart pair of second arms 24*d* extend downwardly from journals 24*a* a selected distance and provide relatively flat surfaces 24*h* to serve as supports for spring members to be discussed. A generally L-shaped spring leg retainer 24*e* is provided at the free end of each arm 24*d* and includes a downwardly extending tab 24*f* spaced slightly from the generally flat spring support surface 24*h* of second arm 24*d*. A pair of space apart spring member receiving cut-out slots 24*g* are formed in pivot member 24, preferably just above pivot journals 24*a*.

As seen in FIGS. 5 and 5(*a*), spring member 26, formed of suitable material such as 410 stainless steel or spring tempered phosphorous bronze, is generally U-shaped having first and second legs 26*a*, 26*b* integrally joined to each other by a curved bight portion 26*c*. The free end of leg 26*b* is formed into a latch 26*d* by first and second opposed wall portions 26*e* that extend in opposite transverse directions from a central portion 26*f* and wrap around with wall portions 26*k* extending toward each other to respective spaced apart free ends 26*g*. The latch is movable between a first latch position in which the latch is biased against the edge of the free end of the disc when the contacts are engaged and a second latch position with the latch received under a portion of the disc when the contacts are disengaged.

The top edges 26*h* of wall portions 26*e* serve as a shelf that is placed underneath the thermostatic disc when the disc moves to the tripped position, as noted above. With reference to FIG. 6(*a*), the leading edge of the shelf formed by top edges 26*h* is disposed a distance A from the center of rotation of journals 24*a*. This serves as the effective length of second arm 24*d* of the pivot member. In the structure shown, distance B is selected to be equal or up to 1.5 times distance A. The outer wall surfaces 26*k* formed by the distal end portions of wall portions 26*e* are preferably inclined slightly from a vertical orientation when the latch is in the first latch position engaging the edge of the free end 16*b* of the disc with the angle of inclination chosen so that any force applied to the disc by the latch will be in a contacts opening direction and interference with actuation of the disc will be minimized. That is, the lower portion of wall surface 26*k*, when in the first latch position as seen in FIG. 1, is closer to the fixed end of the disc than the upper portion of wall surface 26*k*.

With reference to FIG. 5(*a*), spacing the upper edge of wall surface 26*k* from leg 26*b* a distance d of between 0.030 and 0.080 inches has been found to be suitable as has the forming of an angle alpha between a plane in which wall surfaces 26*k* lie and the plane in which leg 26*b* lies of approximately 20 and 50 degrees.

Figure 3:
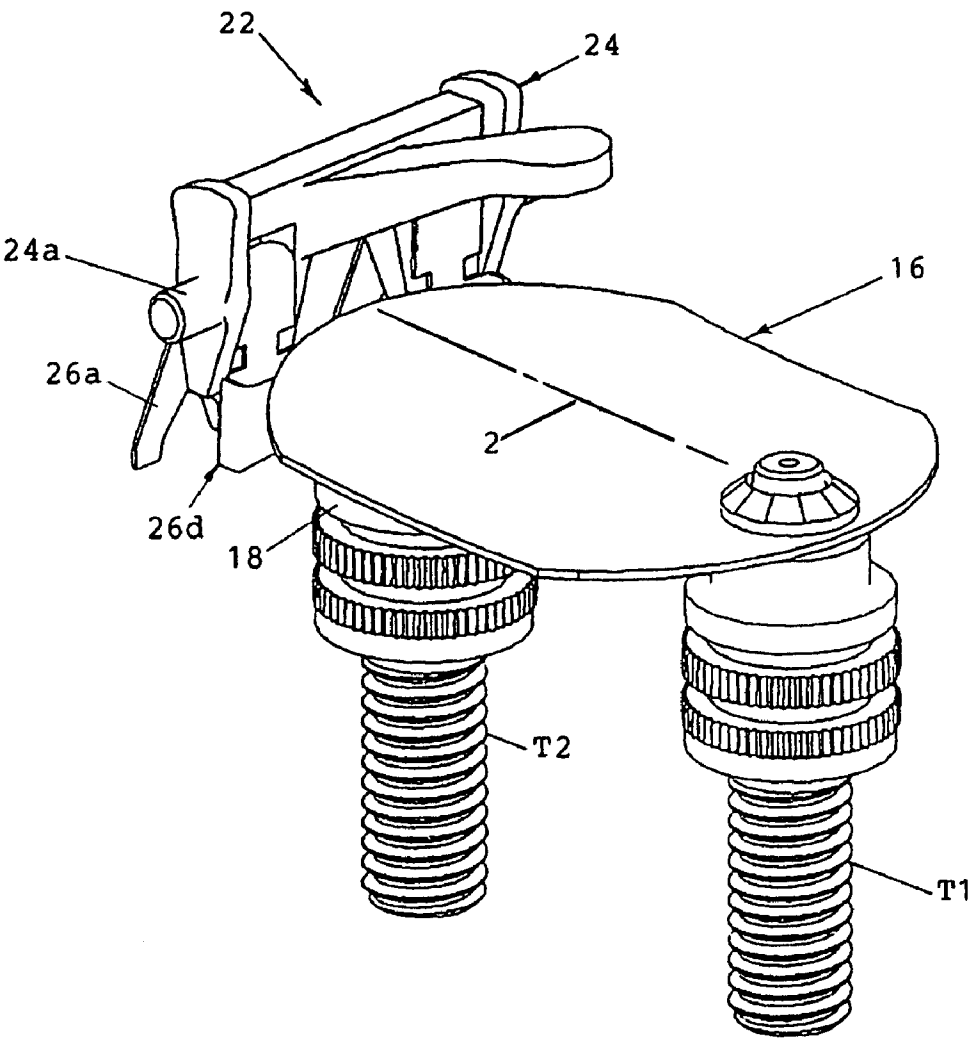
FIG. 3 is a perspective view showing the thermostatic disc and electrical contacts in the FIG. 2 tripped position and showing the associated orientation of the pivot member and latch sub-assembly.

Although a single spring member could be utilized if desired, in the preferred embodiment shown and described herein, two spring members 26 are used with pivot member 24. Leg 26*a* of a respective spring member 26 is inserted through a slot 24*g* of the pivot member until bight portion 26*c* is seated in the slot and L-shaped retainer 24*e* on leg 24*d* of the pivot member is received through a retainer catch opening 26*m* formed in the central portion 26*f* with tab 24*f* of the retainer engaging central surface 26*f* of the spring member below opening 26*m*. Thus latches 26*d* are essentially fixed on pivot member 24 and spaced apart so that they engage disc 16 on either side of movable contact 18 mounted along the longitudinal axis of the disc, as seen, for example, in FIG. 3 which shows latches 26*d* received under disc 16 on either side of contact 18.

Going back to FIGS. 1 and 2, a flexible membrane 28, is placed over electric switch chamber 14 and is seated on inwardly facing ledge 12*c* formed in the upper distal free end of housing side walls 12*b*. A cover 30 is received over the membrane on the ledge and is attached to sidewalls 12*b* to form an environmental seal. Cover 30 is provided with an opening 30*a* for receipt of a combination trip indicator and reset member, such as trip indicator, reset button 32 which is slidable in a tubular portion 30*b* extending outwardly from cover 30. A helical spring 32*a* is placed within tubular portion 30*b* around button 32 and is seated at one end against fixed shoulder 30*c* and at the opposite end against the upper edge of collar 32*b* of button 32 to urge the button toward a recessed position. It will be noted that, for ease of illustration, the compressed helical spring 32*a* is not shown in FIG. 2.

When in the contacts engaged position of FIG. 1, inclined surfaces 26*k* of latches 26*d* are biased against the edge of distal free end portion 16*b* of disc 16 on either transverse side of movable contact 18 mounted on disc 16 along the longitudinal axis of the disc. The bias of the latches is provided by spring legs 26*a* reacting against side wall 12*b* of the housing as seen in FIG. 1. Helical spring 32*a* maintains the combination trip indicator and reset button 32 in its recessed position within tubular portion 30*b* when pivot member is in the FIG. 1 position and the pivot member is restrained from rotation by engagement of latches 26*d* with the disc 16. Upon heating of the thermostatic disc by $I^2R$ heating due to a current overload of a selected level and duration, the disc snaps to a contacts disengaged or tripped position shown in FIG. 2. In this position spring legs 26*a* cause pivot member 24, no longer restrained by the latches engaging the disc, to rotate, in turn moving the latches underneath disc 16 and at the same time causing arm 24*b* to push membrane 28 and combination trip indicator and reset button 32 upwardly against the weaker force of helical spring 32*a* and into an exposed position.

Disc 16 is prevented from moving to the contacts engaged position by the interposition of latches 26*d* between the disc and the stationary contact; and button 32 provides visual indication that the device has tripped to open the circuit regulated thereby. Upon cooling to the reset temperature of the disc, the device can be reset by pushing button 32 downwardly to rotate pivot member 24 clockwise, as seen in FIGS. 1 and 2 until latches 26*d* move out from under the disc.

As many changes could be made in the above constructions without departing from the scope of the invention, such as by forming the latches integrally with the pivot member and/or utilizing a single spring member for biasing the latches. It will also be understood that although a cantilever mounted disc is shown in the preferred embodiment, the invention can be utilized with other discs and mounting arrangements, for example, using a double breaker disc. It is intended that all matter contained in the above description or shown in the accompanying drawings, be interpreted an illustrative and not in a limiting sense.

What is claimed:

1. A thermally activated circuit interrupter comprising a housing having a trip indicator receiving aperture, a stationary electrical contact mounted in the housing, a current carrying thermostatic disc mounted in the housing having a free end defined by an edge and having a movable electrical contact mounted on the free end adapted for movement between a contacts engaged position and a contacts disengaged position, a combination latch, trip indicator and reset assembly having a pivot member with first and second arms and a pivot, a latch movable with the pivot member between a first latch position adjacent to and engageable with the edge of the free end of the thermostatic disc and a second latch position under the free end of the disc when the disc is in the tripped condition, a spring member placing a force on the pivot member urging the pivot member to move the latch toward the second latch position and a trip indicator member movable between an exposed position extending through the trip indicator aperture of the housing and a recessed position, a spring urging the trip indicator member toward the recessed position, the first arm of the pivot member having a force transfer surface to transfer force between the first arm and the trip indicator to move the trip indicator member to the exposed position upon movement of the disc to the contacts open position and the trip indicator member, upon being depressed, transferring motion to the first arm of the pivot member causing the latch to move from the second latch position to the first latch position.

2. A thermally activated circuit interrupter according to claim 1 in which the spring member and the latch are integral with each other.

3. A thermally activated circuit interrupter according to claim 2 in which the latch is formed with a disc engaging surface adapted to engage the edge of the free end of the disc oriented so that when in the first position the disc engaging surface is inclined in a direction such that any force applied by the latch on the disc is in the contacts opening direction.

4. A thermally activated circuit interrupter according to claim 1 in which the spring member is generally U-shaped with first and second legs joined together at a bight portion, the first leg adapted to react against a fixed surface and the second leg coupled to the second arm of the pivot member, the latch being formed from a portion of the second leg.

5. A thermally activated circuit interrupter according to claim 2 in which the disc has a longitudinal axis and the movable contact is aligned with the axis, two spring members are provided, each having a latch, the latches being spaced apart so that they are movable under the free end of the disc on either side of the movable contact.

6. A thermally activated circuit interrupter according to claim 1 in which the thermostatic disc is cantilever mounted in the housing.

7. A thermally activated circuit interrupter according to claim 1 in which the length of the first arm of the pivot member from the pivot to the force transfer surface is B, the latch has a shelf formed with a leading edge, the second arm of the pivot member has a length A extending from the pivot to the leading edge of the shelf that is movable under the disc in the contacts open position and B is equal to or greater than 1.5 times A.

8. A thermally activated circuit interrupter according to claim 7 in which the second arm of the pivot member has a generally flat latch mounting surface and the latch is formed with a disc engaging surface adapted to engage the edge of the free end of the disc forming an angle with said flat latch mounting surface of approximately 20 to 50 degrees.

9. A thermally activated circuit interrupter according to claim 1 in which the latch is formed with a disc engaging surface adapted to engage the edge of the free end of the disc oriented so that when in the first latch position the disc engaging surface is inclined in a direction such that any force applied by the latch on the disc is in the contacts open direction.

10. A thermally activated circuit interrupter comprising a housing having a trip indicator receiving aperture, at least one stationary electrical contact mounted in the housing, a current carrying thermostatic disc mounted in the housing having a movable portion defined by an edge and having at least one movable electrical contact mounted on the movable portion adapted for movement between a contacts engaged position and a contacts disengaged position with a respective stationary contact, a combination latch, trip indicator and reset assembly having a pivot member with first and second arms and a pivot, a latch movable with the pivot member between a first latch position adjacent to and engageable with the edge of said movable portion of the thermostatic disc and a second latch position under said movable portion of the disc when the disc is in the tripped condition, a spring member placing a force on the pivot member urging the pivot member to move the latch toward the second latch position and a trip indicator member movable between an exposed position extending through the trip indicator aperture of the housing and a recessed position, a spring urging the trip indicator member toward the recessed position, the first arm of the pivot member having a force transfer surface to transfer force between the first arm and the trip indicator to move the trip indicator member to the exposed position upon movement of the disc to the contacts open position and the trip indicator member, upon being depressed, transferring motion to the first arm of the pivot member causing the latch to move from the second latch position to the first latch position.

11. A thermally activated circuit interrupter according to claim 10 in which the thermostatic disc is cantilever mounted in the housing.

* * * * *